US008927479B2

(12) United States Patent
Perlas

(10) Patent No.: US 8,927,479 B2
(45) Date of Patent: Jan. 6, 2015

(54) AEROSOL BATHROOM CLEANER

(75) Inventor: Kristina Perlas, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 121 days.

(21) Appl. No.: 13/600,168

(22) Filed: Aug. 30, 2012

(65) Prior Publication Data

US 2014/0066350 A1 Mar. 6, 2014

(51) Int. Cl.

| | |
|---|---|
| ***C11D 1/72*** | (2006.01) |
| ***C11D 1/835*** | (2006.01) |
| ***C11D 1/62*** | (2006.01) |
| ***C11D 3/43*** | (2006.01) |
| ***C11D 1/14*** | (2006.01) |
| ***C11D 17/04*** | (2006.01) |
| ***C11D 3/20*** | (2006.01) |
| ***C11D 3/33*** | (2006.01) |
| ***C11D 1/29*** | (2006.01) |
| ***C11D 1/88*** | (2006.01) |
| ***C11D 1/83*** | (2006.01) |
| ***C11D 3/30*** | (2006.01) |

(52) U.S. Cl.

CPC .. *C11D 1/14* (2013.01); *C11D 1/72* (2013.01); *C11D 17/043* (2013.01); *C11D 1/62* (2013.01); *C11D 3/2006* (2013.01); *C11D 3/33* (2013.01); *C11D 3/2082* (2013.01); *C11D 3/2003* (2013.01); *C11D 1/29* (2013.01); *C11D 1/88* (2013.01); *C11D 3/2041* (2013.01); *C11D 1/83* (2013.01); *C11D 3/30* (2013.01)

USPC ..... 510/238; 510/421; 510/422; 510/423; 510/424; 510/426; 510/427; 510/433; 510/434; 510/480; 510/499; 510/504; 510/505; 510/506

(58) Field of Classification Search

CPC ..... C11D 1/14; C11D 1/29; C11D 1/62; C11D 1/72; C11D 1/83; C11D 1/88; C11D 3/2003; C11D 3/2006; C11D 3/2041; C11D 3/2082; C11D 3/30; C11D 3/33; C11D 17/043

USPC ..... 510/238, 421, 422, 423, 424, 426, 427, 510/433, 434, 480, 488, 499, 504, 505, 506

See application file for complete search history.

(56) References Cited

U.S. PATENT DOCUMENTS

| | | | | |
|---|---|---|---|---|
| 5,814,591 | A | 9/1998 | Mills | |
| 5,948,741 | A | 9/1999 | Ochomogo et al. | |
| 5,948,742 | A | 9/1999 | Chang et al. | |
| 6,150,318 | A * | 11/2000 | Silvester et al. | 510/284 |
| 7,789,278 | B2 | 9/2010 | Ruiz DeGopegui et al. | |
| 2004/0063600 | A1 * | 4/2004 | Williams et al. | 510/375 |
| 2004/0144406 | A1 * | 7/2004 | Garabedian et al. | 134/26 |

OTHER PUBLICATIONS

PCT Search Report No. PCT/US2013/054203; The Clorox Company; Jan. 24, 2014; 3 pages.

* cited by examiner

*Primary Examiner* — Gregory R Delcotto
(74) *Attorney, Agent, or Firm* — Erin Collins

(57) ABSTRACT

An aqueous aerosol bathroom cleaner includes a surfactant, a water-soluble or dispersible organic solvent, a chelating agent and a propellant that comprises n-butane. Comparative data demonstrate that the presence of n-butane in the composition enhances the rate of bathroom soap scum removal relative to aerosol compositions that do not contain n-butane in the propellant. The amount of surfactant present is sufficient so that the composition develops a stable foam upon being dispensed onto a soiled bathroom hard surface. The foam collapses after 10 to 60 seconds to deliver the cleaning components onto the surface.

14 Claims, 2 Drawing Sheets

AEROSOL BATHROOM CLEANER

FIELD OF THE INVENTION

The present invention relates generally to hard surface cleaners, and more particularly to an aerosol cleaning composition that employs n-butane as the propellant and which is especially effective on bathroom soils such as soap scrum.

BACKGROUND OF THE INVENTION

A number of hard surface cleaners have been specially formulated to target bathroom soils. These cleaners may include such constituents as surfactants, acidic cleaners, buffers, agents for combating mildew and fungus, bacteriostats, dyes, fragrances, and the like in order to provide performance and/or aesthetic enhancements. In addition, such cleaners may contain a chelant or sequestrant in order to assist with the removal of the various soap and mineral deposits which are found in typical bathroom soils. Hard surface cleaners generally may be applied by pouring, by application with a cloth or sponge, or by spraying in either an aerosol or non-aerosol fashion.

U.S. Pat. No. 5,948,741 to Ochomogo et ah describes a foam-forming aerosol cleaning composition that is particularly soiled for cleaning hard surfaces. The aerosol formulation includes a chelating agent comprising potassium EDTA and/or ammonium EDTA fox enhanced soil removal. The dispensable composition forms a layer of loam on the surface of stained and solid surfaces which readily collapses in deliver the cleaning formulation. Similarly, U.S. Pat. No. 5,948,742 to Chang et al. describes chelating-containing aerosol cleaning formulations that include a glycoside surfactant for enhanced stability. While conventional compositions provide good aerosol formulations, the industry continues to search of cost-effective improvements to the aerosol formulations that yield even better cleaning performance.

SUMMARY OF THE INVENTION

The present invention is directed to a foam-forming aerosol cleaning composition that is particularly suited for cleaning bathroom hard surfaces. The invention is based in part on the demonstration that formulations of a hard-surface cleaner that employ n-butane as a propellant exhibit significantly improved cleaning performance as compared to formulations that use conventional propellants such a isobutane and/or n-propane.

Accordingly, in one aspect, the invention is directed to a dispensable composition for bathroom hard surface cleaning with improved bathroom soil removal wherein the composition develops a foam upon being dispensed, said composition including:

(a) a surfactant wherein the amount of surfactant present is sufficient so that the composition develops a foam upon being dispensed;

(b) a water-soluble or dispersible organic solvent having a vapor pressure of at least 0.001 mm Hg at 25° C.;

(c) a chelating agent;

(d) a propellant that, comprises n-butane wherein the amount of n-butane in the composition enhances the rate of bathroom soap scam removal relative to the dispensable composition when not containing n-butane in the propellant; and (e) water.

In another aspect, the invention is directed to a method of removing ballroom soap scum from a bathroom hard surface, said method including the steps of:

(a) forming a foam by delivering an admixture via a propellant, wherein the admixture and propellent are derived from a composition that includes;

(i) a surfactant wherein the amount of surfactant present is sufficient such that the composition develops a form upon being dispensed;

(ii) a water-soluble or dispersible organic solvent having a vapor pressure of at least 0.001 mm Hg at 25° C.;

(iii) a chelating agent;

(iv) a propellant that comprises n-butane wherein the amount of n-butane in the composition enhances the rate of bathroom soap scum removal relative to the dispensable composition when not containing n-butane in the propellant; and (v) water, (b) applying the foam to a soiled bathroom hard surface.

In yet another aspect, the invention is directed to a device for dispensing a composition for cleaning bathroom soap scrum from a bathroom hard surface which includes:

(a) a closed container containing the composition that includes:

(i) a surfactant wherein the amount of surfactant present is sufficient so that the composition develops a form upon being dispensed;

(ii) a water-sol able or dispersible organic solvent having a vapor pressure of at least 0.001 mm Hg at 25° C.;

(iii) a chelating agent;

(iv) a propellant that comprises n-butane wherein the amount of n-butane in the composition enhances the rate of bathroom soap scum removal relative to the dispensable composition when not containing n-butane in the propellant; and (v) water; and (b) nozzle means for releasing the composition towards the hard surface whereupon non-propellant components admix and interact with the propellant to terra a foam on the surface, wherein the foam is stable for at least 10 seconds.

DETAILED DESCRIPTION OF THE INVENTION

Figure 1:
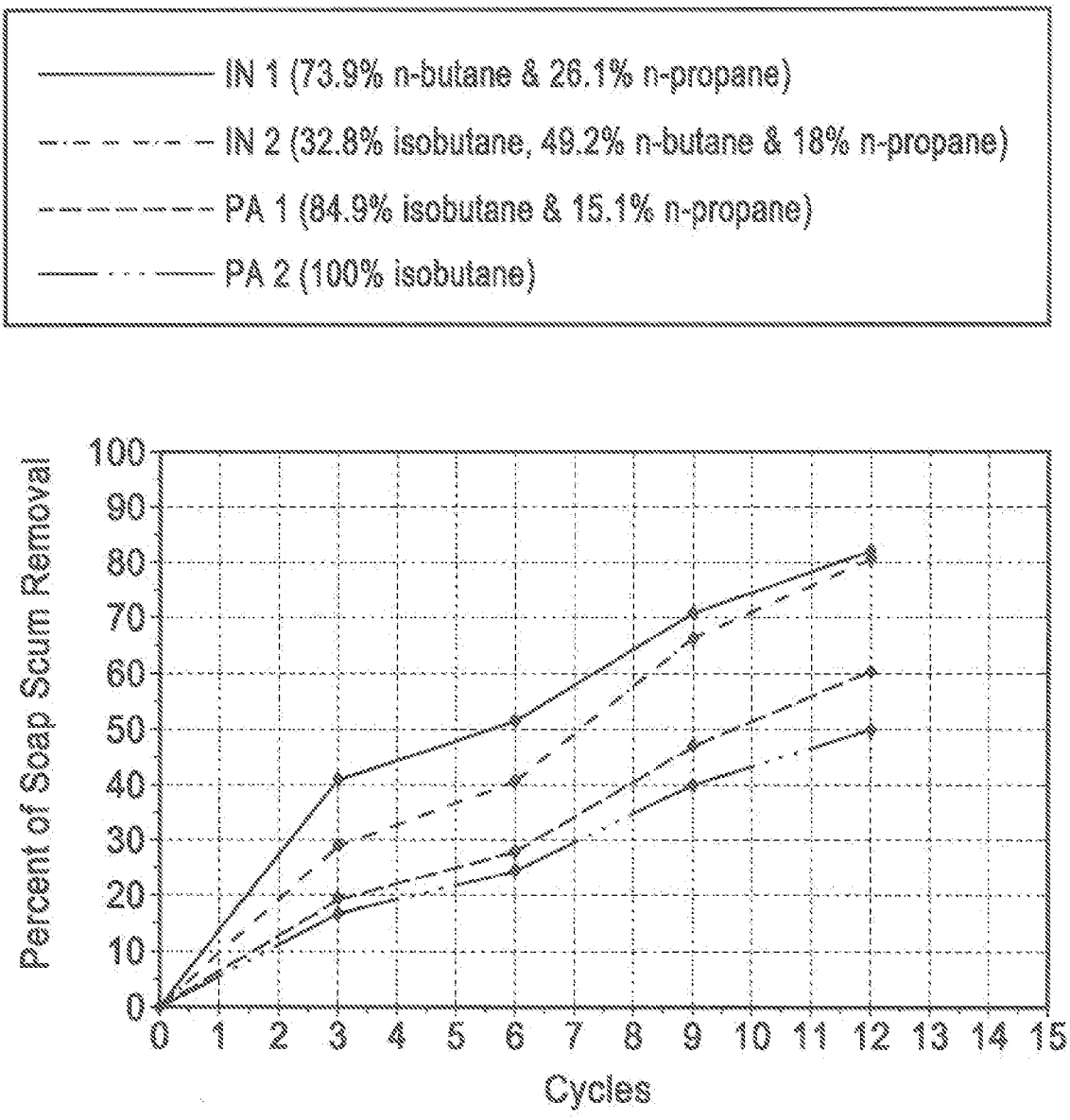
FIGS. 1 and 2 are graphical depictions of the bathroom soil removing performances of aerosol formulations containing n-butane propellant as compared to aerosol formulations that employ other propellants.

The invention provides an aerosol formulation comprising an improved, all-purpose cleaner especially adapted for the complete and rapid removal of typical bathroom soils which include soap scum, mineral deposits, dirt, and various oily substances from a hard surface. The typical bathroom surface is a bath tub, sink, or shower stall, which may have glass doors, and includes vertical wall surfaces typically made of tile, glass, or composite materials. The cleaner is intended to clean such surfaces, and others, by aerosol application of a metered discrete amount of the cleaner via a dispenser onto the surface to be cleaned. A foaming action facilitates dispersal of the active components. The surface is then wiped, thus removing the soil and the cleaner, with or without the need for rinsing with water.

The aerosol formulation comprises a cleaning composition that is mixed with a propellant. A critical feature of the invention is that the propellant comprises n-butane. Comparative data show that aerosol bathroom cleaners dispensed with a propellant containing n-butane outperforms identical aerosol bathroom cleaners that incorporate different propellant components. The cleaning composition or cleaner itself, prior to being mixed with the propellant, is preferably a single phase, clear, isotropic solution, having a viscosity generally less than about 100 centipoise. The cleaning composition itself preferably has the following ingredients: surfactant, water-soluble or dispersible organic solvent, chelating agent, and water. Additional adjuncts in small amounts such as buffers, fragrances, dyes and the like can be included to provide desirable attributes of such adjuncts. Unless otherwise stated, amounts listed herein in percentage ("%'s") are in weight percent of the aerosol formulation that includes the propellant.

1. Solvents

The solvent is a water soluble or dispersible organic solvent having a vapor pressure of at least 0.001 mm Hg at 25° C. It is preferably selected from C1-6 alkanols, C1-6 diols, C1-6 alkyl ethers of alkylene glycols and polyalkylene glycols, alkyl ethers of alkylene glycols, and mixtures thereof. The alkanol can be selected from methanol, ethanol, n-propanol, isopropanol, the various positional isomers of butanol, pentanol, and hexanol, and mixtures of the foregoing. It may also be possible to utilize in addition to, or in place of said alkanols, the diols such as methylene, ethylene, propylene and butylene glycols, and mixtures thereof and including polyalkylene glycols.

It is preferred to use an alkylene glycol ether solvent in the aerosol formulation. The glycol ether solvents can include, for example, monoalkylene glycol ethers such as ethylene glycol monopropyl ether, ethylene glycol mono-butyl ether, propylene glycol monopropyl ether, and propylene glycol mono-n-butyl ether, and polyalkylene glycol ethers such as diethylene glycol monoethyl or monopropyl or monobutyl ether, di- or tri-polypropylene glycol monomethyl ether, di- or tri-polypropylene glycol monoethyl ether, etc., and mixtures thereof. Preferred glycol ethers are diethylene glycol monobutyl ether, also known as 2-(2-butoxyethoxy)ethanol, sold as BUTYL CARBITOL by Union Carbide and Dow chemical Co., ethylene glycol monobutyl ether, also known as butoxyethenol, sold as BUTYL CELLOSOLVE also by Union Carbide, and by Dow Chemical Co., and propylene glycol monopropyl ether, available from a variety of sources. Another preferred alkylene glycol ether is propylene glycol t-butyl ether, which is commercially sold as ARCOSOLVE PTB, by Arco Chemical Co. Propylene glycol n-butyl ether is also preferred. If mixtures of solvents are used, the amounts and ratios of such solvents used are important to determine the optimum cleaning and streak/film performances of the aerosol formulation. It is preferred to limit the total amount of solvent to no more than 50%, more preferably no more than 25%, and most preferably, no more than 15%, of the aerosol formulation. A preferred range is about 0.01-15%. These amounts of solvents are generally referred to as dispersion effective or solubilizing effective amounts, since the other components, such as surfactants, are materials which are assisted into solution by the solvents. The solvents are also important as cleaning materials on their own helping to loosen and solubilize greasy soils for easy removal from the surface cleaned.

2. Surfactants

The surfactant may be an anionic, nonionic, zwitterionic, cationic surfactant, or mixtures thereof. A quaternary ammonium surfactant, which is a cationic surfactant, can be added.

a. Anionic Nonionic, Zwitterionic, and Surfactants

The anionic surfactants may generally include, for example, those compounds having an hydrophobic group of C6-C22 (e.g., alkyl, alkylaryl alkenyl, acyl, long chain hydroxyalkyl, etc.) and at least one water-solubilizing group selected from the group of sulfonate, sulfate, and carboxylase. Preferred are linear or branched C6-14 alkane sulfonate, alkyl benzene sulfonate, alkyl sulfate, or generally, a sulfated or sulfonated C6-14 surfactant. Examples of these surfactants include WITCONATE NAS, an 1-octane sulfonate available from Witco Chemical Company; PILOT L-45, a C11.5 alkylbenzene sulfonate (referred to as "LAS") from Pilot Chemical Co.; BIOSOFT S100 and S130, non-neutralized linear alkylbenzene sulfonic acids (referred to as "HLAS"), and S40, also an LAS, all from Stepan Company; and sodium dodecyl and lauryl sulfates. The use of acidic surfactants having a higher actives level may be desirable due to cost-effectiveness.

The nonionic surfactants may be selected from alkoxylated alcohols, alkoxylated phenol ethers, glycosides, and the like. Trialkyl amine oxides, and other surfactants often referred to as "semi-polar" nonionics, may also be employed.

The alkoxylated alcohols may include, for example, ethoxylated, and ethoxylated and propoxylated C6-16 alcohols, with about 2-10 moles of ethylene oxide, or 1-10 and 1-10 moles of ethylene and propylene oxide per mole of alcohol, respectively. Exemplary surfactants are available from Shell Chemical under tire trademarks NEODOL and ALFONIC, and from Huntsman Chemicals under the trademark SURFONIC (e.g., SURFONIC L12-6, a C10-C12 ethoxylated alcohol with 6 moles of ethylene oxide, and SURFOIC L12-8, a C10-C12 ethoxylated alcohol with 8 moles of ethylene oxide).

The alkoxylated phenol ethers may include, for example, octyl- and nonylphenol ethers, with varying degrees of alkoxylation, such as 1-30 moles of ethylene oxide per mole of phenol. The alkyl group may vary, for example, from C6-16, with octyl- and nonyl chain lengths being readily available. Various suitable products are available from Rohm & Haas under the trademark TRITON, such as TRITON N-57, N-101, N-111, X-45, X-100, X-102, from Mazer Chemicals under the trademark MACOL, from GAF Corporation under the trademark IGEPAL, and from Huntsman under the trademark SULFONIC.

The glycosides, particularly the alkyl polyglycosides, are preferred as a surfactant for the aerosol formulation; an especially preferred glycoside surfactant is APG 325n, which is a nonionic alkyl polyglycoside that is manufactured by the Henkel Corporation.

The alkoxylated alcohols and alkyl polyglycosides may both permit the formulation of a composition that is stable and non-corrosive when contained, within a pressurized tin-plated steel can of the type commonly used for containment of aerosol formulations, the alkyl polyglycoside is additionally preferred because it does not require an extra heating step to effect a single-phase solution of that ingredient prior to mixing with the remainder of the ingredients. By way of comparison, the ethoxylated alcohol SURFONIC L12-6, while having generally favorable stability/corrosiveness characteristics, is a two-phase surfactant which requires heating prior to addition. The related surfactant SURFONIC L12-8, on the other hand, is available as a one-phase ingredient, like the alkyl polyglycoside APG 325n, but exhibits generally less favorable stability/corrosion properties. The alkyl polyglycoside affords a surprising combination of stability/non-corrosiveness in an easy-to-process single-phase surfactant.

Compositions, containing other surfactants, such as some amine oxides, tend to be even less compatible with the tin-plated steel can environment (or even with steel cans that are lined with, e.g., an epoxy phenolic coating), becoming unstable and/or causing corrosion of the can (at least not, perhaps, without excessively large amounts of stabilizing agents and/or corrosion inhibitors). Tin-plated steel cans are desirable as containers for aerosol compositions because they are more readily available and are less expensive than aluminum or specially lined steel cans.

The amine oxides, are also referred to as mono-long chain, di-short chain, and trialkyl amine oxides. These amine oxides can also be ethoxylated or propoxylated. The preferred amine oxide is lauryl amine oxide. The commercial sources for such amine oxides are BARLOX 10, 12, 14 and 16 from Lonza Chemical Company, VAROX by Witco and AMMONYX by Stepan Company. The amine oxides are less preferred for inclusion in the aerosol formulation where the container for the composition is a tin-plated steel (aerosol) can due to their propensity to cause corrosion and become unstable. However, such compositions when contained, for example, in plastic spray bottles, are stable.

A further semi-polar nonionic surfactant is alkylamidoalkylenedialkylamine oxide. Additionally, the surfactant could be ethoxylated (1-10 moles of EO/mole) or propoxylated (1-10 moles of PO/mole). This surfactant is available from various sources as a cocoamidopropyldimethyl amine oxide; it is sold by Lonza Chemical Company under the brand name BARLOX C. Additional semi-polar surfactants may include phosphine oxides and sulfoxides.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwittenionic surfactants for use herein.

The amounts of surfactants present are to be somewhat minimized, for purposes of cost-savings and to generally restrict the dissolved actives which could contribute to leaving behind residues when the aerosol, is applied to a surface. However, the amounts added are generally about 0.001-15%, more preferably 0.002-3.00% surfactant. These are generally considered to be cleaning-effective amounts.

b. Quaternary Ammonium (Cationic) Surfactant

The aerosol formulation may include a cationic surfactant, specifically, a quaternary ammonium surfactant. These types of surfactants are typically used in bathroom cleaners because they are generally considered "broad spectrum" antimicrobial compounds, having efficacy against both gram positive (e.g., *Staphylococcus* sp.) and gram negative (e.g., *Escherischia coli*) microorganisms. Thus, the quaternary ammonium surfactant, or compounds, are incorporated, for bacteriostatic/disinfectant purposes and should be present. In amounts effective for such purposes.

The quaternary ammonium compounds are selected from mono-long-chain, tri-short-chain, tetraalkyl ammonium compounds, di-long-chain, di-short-chain tetraalkyl ammonium compounds, trialkyl, mono-benzyl ammonium compounds, and mixtures thereof. By "long" chain is meant about C6-30 alkyl. By "short" chain is meant about C1-5 alkyl, preferably C1-3. Preferred materials include the BTC 2125 series from Stepan, which comprise di-C24-dialkyl ammonium chloride and BTC 835 series which comprise alkyl dimethyl benzyl ammonium chloride (C12-16) and the BARQUAT and BARDAC series, such as BARDAC MB 2050, from Lonza Chemical. Preferred quaternary ammonium compounds include, for example, alkyl dimethyl benzyl ammonium chloride, alkyl dimethyl ethylbenzyl ammonium chloride, dodecyl methyl ammonium chloride, didecyl dimethyl ammonium carbonate, and didecyl dimethyl ammonium bicarbonate. Typical amounts of the quaternary ammonium compound range from preferably about 0-5%, more preferably about 0.001-2% by weight of the aerosol formulation.

3. Chelating Agent

The chelating agent preferably composes of ethylenediamine-tetraacetate (EDTA), methylglycenediacetic acid (MGDA), or glutamic acid diacetic acid (sodium GLDA). Particularly preferred chelating agents include tri- or tetrapotassium ethylenediamine-tetraacetate (potassium EDTA), tri or tetraammonium ethylenediamine-tetraacetate (ammonium EDTA), di or tetrasodium salt, of tetraammonium ethylenediamine-tetraacetate (sodium EDTA), trisodium salt of methylglycenediacetic acid (sodium MGDA), tetrasodium salt of glutamic acid diacetic acid (sodium GLDA). The chelating agent enhances the bathroom soil removal capability of the cleaning formulation. The chelating agent preferably comprises 0.01-2.5%, more preferably 1-10%, by weight of the aerosol formulation.

4. Water and Miscellaneous

Since the aerosol formulation has an aqueous cleaner with relatively low levels of actives, the principal ingredient is water, which should be present at a level of at least about 50%, more preferably at least about 80%, and most preferably, at least about 90% of the aerosol formulation. Deionized water is preferred.

Small amounts of adjuncts can be added for improving cleaning performance or aesthetic qualities of the cleaner. For example, buffers can be added to maintain a constant pH (which for the invention is between about 7-14, more preferably between about 8-13; formulations containing the tripotassium and/or tri ammonium salts will naturally be at a lower end of the range as compared to the corresponding tetra salts). These buffers include, for example, NaOH, KOH, $Na_2CO_3$, and $K_2CO_3$ as alkaline buffers, and phosphoric, hydrochloric, sulfuric, and citric acids as acidic buffers, among others. Builders, such as phosphates, silicates, and carbonates, may be desirable. Further solubilizing materials, such as hydrotropes (e.g., water soluble salts of low molecular weight organic acids such as the sodium, or potassium salts of cumene-, toluene-, benzene-, and xylene sulfonic acid), may also be desirable. Aesthetic adjuncts include fragrances or perfumes, such as those available from Symrise, Givaudan, IFF, Quest, Sozio, Firmenich, Dragoco and others, and dyes or colorants which can be solubilized or suspended in the formulation, such as diaminoanthraquinones. Water-insoluble solvents may sometimes be desirable as added grease- or oily soil-cutting agents. These types of solvents include tertiary alcohols, hydrocarbons (e.g., alkanes), pine-oil, d-limonene and other terpenes and terpene derivatives, and benzyl alcohols. Thickeners, such as calcium carbonate, sodium bicarbonate, aluminum oxide, and polymers, such as polyacrylate, starch, xanthan gum, alginates, guar gum, cellulose, and the like, may be desired additives. The use of some of these thickeners (e.g., $CaCO_3$ or $NaHCO_3$) is to be distinguished from their potential use as builders, generally by particle size or amount used.

5. Propellant

The cleaning composition is delivered, in the form of an aerosol. Specifically, in order to apply and build the foam, the cleaning composition is delivered via a liquefied propellant that must include n-butane. Preferably, the propellant comprises about 0.1% to 30%, more preferably about 3% to 8%, and most preferably about 3% to 6% of the aerosol formulation. The amount of propellant creates sufficient pressure to expel the cleaning composition from the container and provides good control over the nature of the spray upon discharge of the aerosol formulation. In addition to n-butane, the propellant may also include other gases such as, for example, a hydrocarbon, of from 1 to 10 carbon atoms, such as methane, ethane, n-propane, isobutane, n-pentane, isopentane, and mixtures thereof. The propellant may also include halogenated hydrocarbons including, for example, fluorocarbons, chlorocarbons, chlorofluorocarbons, and mixtures thereof. The propellant may also consist of hydrocarbon ethers such as dimethyl ether and compressed gasses such as nitrogen or carbon dioxide. In the ease where the propellant comprises a liquefied gas propellant mixture, the n-butane preferably comprises 30% to 100% of the propellant mixture. Increasing the percentage of n-butane in the propellant causes an incremental or better enhancement of the rate of soap scum removal.

The aerosol formulation is preferably stored in and dispensed from a pressurized closed container or can that is equipped with a nozzle so that an aerosol of the formulation can be readily sprayed onto a surface to create a relatively uniform layer of foam that is stable for at least 10 seconds and preferably for at least 60 seconds. Dispensers are known in the art and are described, for example, in U.S. Pat. No. 7,789,278 to Ruiz de Gopegui et al., U.S. Pat. No. 4,780,100 to Moll, U.S. Pat. No. 4,652,389 to Moil and U.S. Pat. No. 3,541,581 to Monson which are incorporated herein by reference. The pressure within the dispenser preferably ranges from about 40 to 58 lbs./in$^2$, more preferably 40 to 50 lbs./in$^2$, and most preferably 40 to 47 lbs./in$^2$ at 700° F. (21° C.).

When the container is a tin-plated steel can, it is advantageous to add one or more common inhibitors to prevent or at least reduce the rate of expected corrosion of such a metallic dispenser. Quaternary ammonium surfactants, if present, can cause corrosion. Further, the potassium salt of EDTA appears to have a more corrosive, effect on metal containers than the tetrasodium salt. Preferred corrosion inhibitors include, for example, amine neutralized alkyl acid phosphates, amine neutralised alkyl acid phosphates and nitroalkanes, amine neutralized alkyl acid phosphates and volatile amines, diethanolamides and nitroalkanes, amine carboxylates and nitroalkanes, esters, volatile silicones, amines and mixtures thereof. Specific inhibitors include, for example, sodium lauroyl sarcosinate, available from Stepan Company under the trademark MAPROSYL 30, sodium meta silicate, sodium or potassium benzoate, triethanolamine, sodium nitrite and morpholine. When employed, the corrosion inhibitor preferably comprises about 0.1%, to 5% of the aerosol formulation.

In loading the dispenser, the non-propellant components of the aerosol formulation are mixed into a concentrate and loaded into the dispenser first. Thereafter, the liquefied gaseous propellant is inserted before the dispenser is fitted with a nozzle.

EXPERIMENTAL

Aerosol formulations, that were identical in every respect except for the propellant(s) used, were tested with, respect to their soap scum removing capabilities. Ceramic tiles soiled with simulated soap scum, were employed. In particular, the laboratory soil (modified from industry accepted standards) that simulates (aged) soap scum was prepared by making a calcium stearate suspension (ethanol, calcium stearate and water). This soap scum was then sprayed onto black ceramic tiles which were baked at 165-170° C. for one hour, then allowed to cool.

A proprietary, automated reader/scrubber that was equipped with a scrubber arm, which applied a cleaning action to a soap scum soiled title surface, was used. The reader/scrubber measured the percentage of soap scum removed by calibrating with a clean tile, which would establish 100% clean, versus a completely soiled tile, which would establish a zero % clean. Each soiled tile cleaned by the scrubber was measured during the cleaning by the reader, which was equipped with a camera that captured an image of the title, to establish the differences in shading between, the initially completely soiled panel and the completely cleaned one.

Table 1 sets forth the active components in the aerosol formulations tested and Table 2 sets forth the proportion of propellant(s) in the five aerosol formulations tested. Aerosol formulations and the propellant(s) were loaded into and dispensed from a conventional aerosol canister. The vapor pressure refers to the pressure in the canister after being loaded with the aerosol formulation.

TABLE 1

| Composition | Manufacturer | % Active in Formula |
|---|---|---|
| DI Water | | 88.96 |
| K4 EDTA | Versene K4 Dow | 2.4750 |
| Ethylene glycol monobutyl ether | Butyl Carbitol Dow | 1.0000 |
| Citric Acid | | 0.3000 |
| Amine Oxide | Ammonyx LMDO (Stephan) | 0.8333 |
| Alkylpolyglucoside | APG 325N (BASF) | 0.8333 |
| Quatenary Ammonium Chloride | BTC 835 (Stepan) | 0.3000 |
| Sodium Metasilicate Pentahydrate | | 0.1000 |
| Fragrance | | 0.2000 |
| Propellant | | 5.0000 |

TABLE 2

| Propellant | isobutane | n-butane | n-propane | vapor pressure |
|---|---|---|---|---|
| Prior Art 1 | 84.9 wt % | 0 | 15.1 wt % | 46 psig |
| Invention 1 | 0 | 73.9 wt % | 26.1 wt % | 46 psig |
| Invention 2 | 32.8 wt % | 49.2 wt % | 18 wt % | 42 psig |
| Prior Art 2 | 100% | 0 | 0 | 31 psig |
| Invention 3 | 0 | 100% | 0 | 17 psig |

Example 1

In this experiment, approximately one gram of the aerosol formulation was initially applied onto a soiled tile and the cleaning components therein were allowed to dissipate onto the surface of the tile as the foam collapsed over a three minute wait period. Thereafter, an image of the tile was taken, and then the scrubber arm was activated, to apply cleaning action onto the tile for twelve cycles, with each cycle representing a back-and-forth action of the scrubber arm. An image was taken following three cycles and approximately another gram of the aerosol formulation was applied after the sixth cycle. There was no second wait period after the aerosol formulation was applied the second time.

For this Example 1, prior art aerosol formulations 1 and 2 in which the propellant consisted of (i) a mixture of isobutane and n-propane and (ii) isobutane only, respectively, were compared, to inventive aerosol formulations 1 and 2 in which the propellant consisted of (1) a mixture of n-butane and n-propane and (ii) a mixture of isobutane, n-butane, and n-propane, respectively. Table 3 sets forth the amount of aerosol formulation that was applied onto the tiles tested duration each of four repetitions or trials for each aerosol formulation. For instance, in the first repetition for prior art aerosol formulation, 0.8 and 1.1 gram of the aerosol formulation was applied initially and after six cycles, respectively.

In the second trial 0.6 and 0.7 gram of the aerosol formulation was applied initially and after six cycles and so forth.

TABLE 3

| | Amount Added Prior Art 1 | Amount Added Invention 1 | Amount Added Invention 2 | Amount Added Prior Art 2 |
|---|---|---|---|---|
| 1 | 0.8 | 1.1 | 0.8 | 0.6 |
| 2 | 1.1 | 1.2 | 1.2 | 0.9 |
| 3 | 0.6 | 0.9 | 1.0 | 0.9 |
| 4 | 0.7 | 0.7 | 1.2 | 1.0 |
| 5 | 0.9 | 1.2 | 0.9 | 1.0 |
| 6 | 1.1 | 0.9 | 1.0 | 0.8 |
| 7 | 1.0 | 0.7 | 1.0 | 0.8 |
| 8 | 1.1 | 0.8 | 0.8 | 0.8 |
| avg | 0.9 | 0.9 | 1.0 | 0.8 |
| std | 0.2 | 0.2 | 0.2 | 0.1 |

Table 4 sets forth the percentage of soil removed from the tile after twelve cycles for each of the four repetitions average amount of soil removed for each aerosol formulation tested. Also included is the average percentage of soil removed for die four,

TABLE 4

| Treatment | Repetition | Cycle | PctSRE | Average SRE | |
|---|---|---|---|---|---|
| Prior Art 1 | 1 | 12 | 48.49 | | |
| Prior Art 1 | 2 | 12 | 32.58 | | |
| Prior Art 1 | 3 | 12 | 64.63 | | |
| Prior Art 1 | 4 | 12 | 52.68 | 49.59 | |
| Invention 1 | 1 | 12 | 96.28 | | |
| Invention 1 | 2 | 12 | 74.42 | | |
| Invention 1 | 3 | 12 | 95.26 | | |
| Invention 1 | 4 | 12 | 60.29 | 81.81 | |
| Invention 2 | 1 | 12 | 94.87 | | |
| Invention 2 | 2 | 12 | 76.83 | | |
| Invention 2 | 3 | 12 | 57.76 | | |
| Invention 2 | 4 | 12 | 93.30 | 80.69 | |
| Prior Art 2 | 1 | 12 | 48.42 | | |
| Prior Art 2 | 2 | 12 | 58.30 | | |
| Prior Art 2 | 3 | 12 | 71.92 | | ef: 336.474 |
| Prior Art 2 | 4 | 12 | 62.76 | 60.35 | |

The results are shown in FIG. 1 in which the percentage of soap scum removed vs. cycle is plotted. In general, aerosol formulations containing n-butane propellants showed directionally better cleaning performance. While bath aerosol formulations that comprised n-butane achieved almost the same level of soil removal of approximately 80% after 12 cycles, aerosol formulation IN1, which contained the higher percentage of n-butane, exhibited better performance following six cycles and one initial application of the aerosol formulation. In contrast, after 12 cycles the prior art aerosol formulations PA1 and PA2 only achieved approximately 60% and 50%, soap scum removal, respectively.

Example 2

In this Example 2, the same protocol as described in Example 1 was employed to test prior art aerosol formulations 1 and 2 and inventive aerosol formulations 1 and 3 but a higher amount of aerosol formulation was applied initially and alter six cycles as set forth in Table 5. Inventive aerosol formulation 3 contained only n-butane as the propellant.

TABLE 5

| | Amount Added Invention 3 | Amount Added Prior Art 2 | Amount Added Invention 1 | Amount Added Prior Art 1 |
|---|---|---|---|---|
| 1 | 2.5 | 2.9 | 2.3 | 2.5 |
| 2 | 2.9 | 2.7 | 2.5 | 2.4 |
| 3 | 2.6 | 2.6 | 2.3 | 2.2 |
| 4 | 2.5 | 2.4 | 2.8 | 3.0 |
| 5 | 2.5 | 2.4 | 2.5 | 3.0 |
| 6 | 2.7 | 3.0 | 2.7 | 3.3 |
| 7 | 2.6 | 2.1 | 2.7 | 2.3 |
| 8 | 2.4 | 2.4 | 2.3 | 2.3 |
| 9 | 3.0 | 3.0 | 2.4 | 2.6 |
| 10 | 2.7 | 2.3 | 2.8 | 2.9 |
| 11 | 2.2 | 2.7 | 2.9 | 3.1 |
| 12 | 2.9 | 2.5 | 2.8 | 2.2 |
| avg | 2.6 | 2.6 | 2.6 | 2.7 |
| std | 0.2 | 0.3 | 0.2 | 0.4 |

Figure 2:
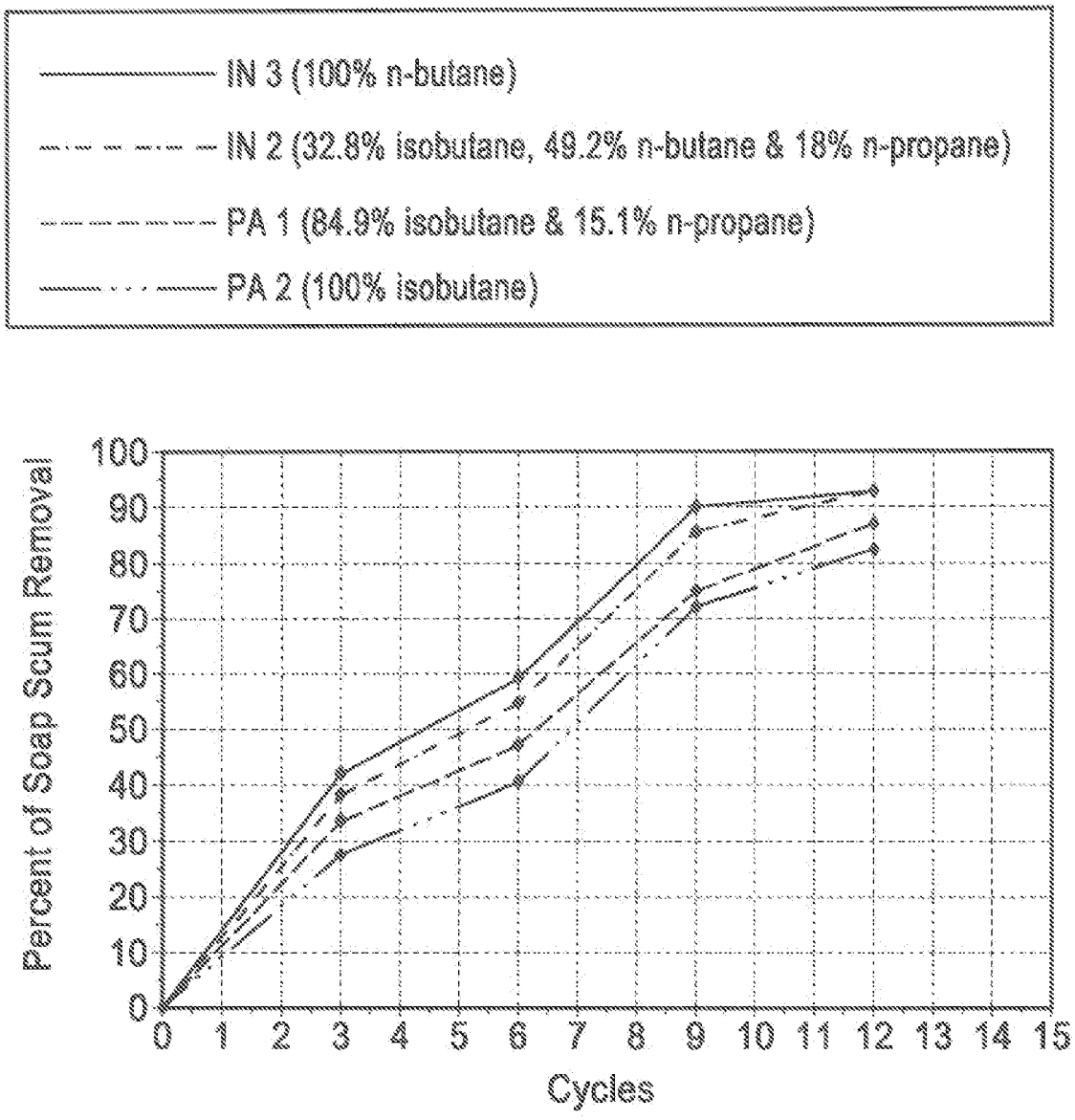

The results are shown in FIG. 2. Given that the amounts of aerosol formulation applied were considerably higher than in Example 1, a much higher percentage of soap scum removal was achieved for ail the aerosol formulations. Nonetheless, the data demonstrate that aerosol formulations containing n-butane propellants performed better than those that did cot contain n-butane.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A hard surface aerosol cleaning composition with improved bathroom soil removal wherein the composition develops a foam upon being dispensed, said composition consisting of:

(a) 0.002 to 3% by weight of a nonionic surfactant;

(b) about 0.001 to 2% by weight of a cationic surfactant;

(c) about 0.01% to 15% by weight of a water-soluble or dispersible organic solvent having a vapor pressure of at least 0.001 mm Hg at 25° C.;

(d) a chelating agent;

(e) about 0.1% to 30% by weight of a propellant, wherein 30% to 100% by weight of the propellant is n-butane; and (f) water; and (g) optionally, one or more of the following adjuncts selected from the group consisting of: builders, buffers, fragrances, perfumes, thickeners, dyes, colorants, pigments, foaming stabilizers, water-insoluble organic solvents, corrosion inhibitors, hydrotropes, and mixtures thereof; and wherein the composition has a vapor pressure between about 46 and 17 psig.

2. The composition of claim 1 wherein the propellant is present in an amount from 0.1% to 30% by weight of the composition.

3. The composition of claim 1 wherein the propellant is present in an amount from 3% to 8% by weight of the composition.

4. The composition of claim 1 wherein the propellant consists of n-butane.

5. The composition of claim 1 wherein the nonionic surfactant is selected from the group consisting of: alkoxylated alcohols, alkoxylated phenol ethers, glycosides, amine oxides and mixtures thereof.

6. The composition of claim 1 wherein the solvent is selected from the group consisting of alkanols, diols, polyalkylene glycols, alkyl ethers of alkylene glycols, polyalkylene glycols, and mixtures thereof.

7. The composition of claim 1 wherein the chelating agent is selected from the group consisting of ethylenediamine-tetraacetate, methylglycenediacetic acid, glutamic acid diacetic acid, and mixtures thereof.

8. The composition of claim 1 wherein the chelating agent is selected from the group consisting of tri- or tetrapotassium ethylenediamine-tetraacetate, tri or tetraammonium ethylenediamine-tetraacetate, di or tetrasodium salt of tetraammonium ethylenediamine-tetraacetate, trisodium salt of methylglycenediacetic acid, tetrasodium salt of glutamic acid diacetic acid, and mixtures thereof.

9. The composition of claim 1 wherein the chelating agent is present in an amount from 0.01% to 25% by weight of the composition.

10. The composition of claim 1 wherein the cationic surfactant is a quaternary ammonium compound.

11. The composition of claim 10 wherein the quaternary ammonium compound is selected from the group consisting of alkyl dimethyl benzyl ammonium chloride, alkyl dimethyl ethylbenzyl ammonium chloride, dodecyl methyl ammonium chloride, didecyl dimethyl ammonium carbonate, didecyl dimethyl ammonium bicarbonate, and mixtures thereof.

12. A device for dispensing an aerosol composition for cleaning bathroom soap scrum from a bathroom hard surface which consists of:

(a) a closed container containing the composition, wherein said composition consists of:

(i) about 0.002 to 3% by weight of a nonionic surfactant;

(ii) about 0.001 to 2% by weight of a quaternary ammonium compound;

(iii) about 0.01% to 15% by weight of a water-soluble or dispersible organic solvent having a vapor pressure of at least 0.001 mm Hg at 25° C.;

(iv) a chelating agent;

(v) about 0.1% to 30% by weight of a propellant, wherein 30% to 100% by weight of the propellant is n-butane;

(vi) water; and (vii) optionally, one or more of the following adjuncts selected from the group consisting of: builders, buffers, fragrances, perfumes, thickeners, dyes, colorants, pigments, foaming stabilizers, water-insoluble organic solvents, corrosion inhibitors, hydrotropes, and mixtures thereof; and wherein the composition has a vapor pressure between about 46 and 17 psig; and (b) nozzle means for releasing the composition towards the hard surface whereupon non-propellant components admix and interact with the propellant to form a foam on the surface, wherein the foam is stable for at least 10 seconds.

13. The device of claim 12 wherein the propellant consists of n-butane.

14. The device of claim 12 wherein the propellant is present in an amount of 3% to 8% by weight of the composition.

* * * * *